US005080599A

United States Patent [19]

Wimberly

[11] Patent Number: 5,080,599

[45] Date of Patent: Jan. 14, 1992

[54] DUAL ELECTRICAL SOCKET SAFETY COVER

[75] Inventor: Joseph W. Wimberly, Villa Park, Ill.

[73] Assignee: Taurus Safety Products, Inc., Lombard, Ill.

[21] Appl. No.: 565,697

[22] Filed: Aug. 13, 1990

[51] Int. Cl.[5] ..... H01R 13/44

[52] U.S. Cl. ..... 439/142; 439/148; 174/67

[58] Field of Search ..... 439/136, 142, 148; 174/67

[56] References Cited

U.S. PATENT DOCUMENTS 2,728,894 12/1955 Peters ..... 439/142
2,932,811 4/1960 Abraham et al. ..... 439/148
4,801,271 1/1989 Piper ..... 439/142

*Primary Examiner*—Paula A. Bradley
*Attorney, Agent, or Firm*—Hill, Van Santen, Steadman & Simpson

[57] ABSTRACT

A dual electrical socket safety cover construction comprises a pair of cover panel members, a hinge structure connecting the cover members, the hinge structure being arranged for attachment between a pair of electrical sockets to be covered, and each of the cover members having pressure release retaining engagement prong structure to be gripped by the usual electrical plug prong spring fingers, whereby it will require substantially adult digital manipulation to release the covers from their fully covering relation to the sockets.

16 Claims, 1 Drawing Sheet

DUAL ELECTRICAL SOCKET SAFETY COVER

BACKGROUND OF THE INVENTION

The present invention relates to improvements in safety covers for electrical sockets, and is more particularly concerned with a new and improved dual electrical socket safety cover construction. Crawling infants and toddlers are frequently attracted to the electrical sockets customarily present on dwelling walls. More particularly, the small socket openings for receiving the connecting prongs of a plug or connector provide an attractive nuisance into which an electrically conducting object may be thrust with possibly serious consequences.

SUMMARY OF THE PRESENT INVENTION

An important object of the present invention is to provide a new and improved dual electrical socket safety cover construction which can be supplied at low cost and can be easily installed without requiring any special reconstruction or expertise for mounting the same.

Another object of the invention is to provide a new and improved dual electrical socket safety cover structure providing hingedly connected cover members.

A further object of the invention is to provide a new and improved dual electrical socket safety cover construction that can be molded at low cost from a dielectric plastic material.

In accordance with the present invention there is provided a dual electrical socket safety cover construction comprising a pair of cover members, a hinge structure connecting the members, means for attachment of the hinge structure between a pair of electrical sockets to be covered, and means on each of the cover members for pressure release retention with the sockets.

BRIEF DESCRIPTION OF THE DRAWINGS

Other objects, features and advantages of the present invention will be readily apparent from the following description of certain representative embodiments thereof, taken in conjunction with the accompanying drawings, although variations and modifications may be effected without departing from the spirit and scope of the novel concepts embodied in the disclosure, and in which.

DETAILED DESCRIPTION

Figure 1:
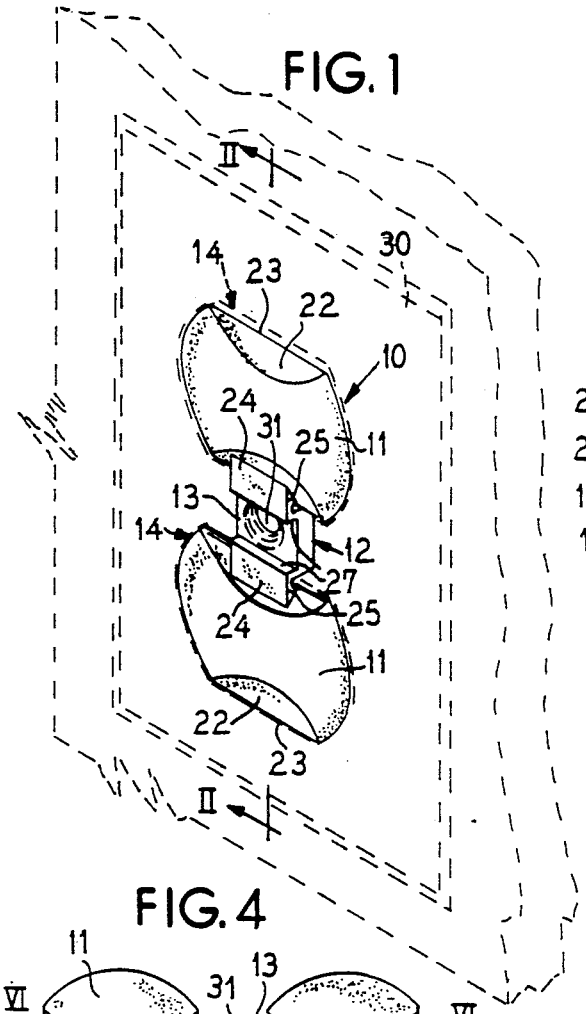
FIG. 1 is a more or less schematic illustration showing a dual electrical socket safety cover construction embodying the present invention.

As shown in the drawings, a dual electrical socket safety cover 10 embodying the present invention comprises a pair of cover panel members 11, a hinge structure 12 connecting the members 11, means comprising a link part 13 for attachment of the hinge structure between a pair of sockets 14 to be covered, and means comprising prongs 15 on each of the cover members 11 for pressure release retention with the sockets 14 and more particularly the customary spring gripping fingers 17 within the sockets aligned with the prong receiving slots 18 of the sockets. As is customary, the sockets 14 are mounted in or comprise part of a body structure 19 which is mounted in a junction box 20 into which electrical wiring 21 is led in the usual manner and electrically secured to the electrically conducting fingers 17.

More specifically, the safety cover construction 10 is desirably made as a one-piece molding from a semi-rigid plastic material possessed of substantial resilience in thin section. Moldable plastics having the desired characteristics are readily available from numerous sources. Each of the cover members 11 is preferably attractively shaped symmetrically and allochirally relative to the other. Each of the cover members 11 has an outwardly arched stiff crowned body portion with a flat inner face which is engageable against the corresponding flat outer face of the associated socket 14. At its distal end or edge each of the cover members has a slabbed off oblique digitally engageable surface 22 terminating in a thin edge 23 facilitating engagement therewith of an adult person's fingernail for releasing the cover member 11 and hingedly swinging it away from its covering relation to the associated socket 14, when desired.

At its proximal edge or side each of the cover members 11 is provided with a relatively short, limited width hinge anchor bar 24 along which is provided a resiliently flexible integral hinge 25 connected by a rib 27 to the attachment base bar link 13. The connecting ribs 27 serve to offset the attachment link 13 complementary to the customary depression or valley 28 between the socket members 14. The link member 13 fits freely in the recess 28 in complementary manner to retain the dual cover unit against turning out of proper registration with the associated sockets.

For securing the safety cover 10 releasably in its operating position, the customary screw 29 for attaching the customary escutcheon plate 30 in place over the outlet box 20 may be efficiently employed. For this purpose, the link member 13 is desirably provided with a countersunk screw hole 31 which matches the customary screw hole for the escutcheon screw in the underlying socket assembly. Through this arrangement, the cover member panels 11 can be readily swung into and out of covering relation relative to the associated sockets.

To facilitate the swinging of the prongs 15 into and out of position relative to the spring gripping fingers 17, each of the prongs is provided with a clearance or relief curvature edge 32 facing generally toward the fingers grip distal edge 23 of the associated cover.

Figure 2:
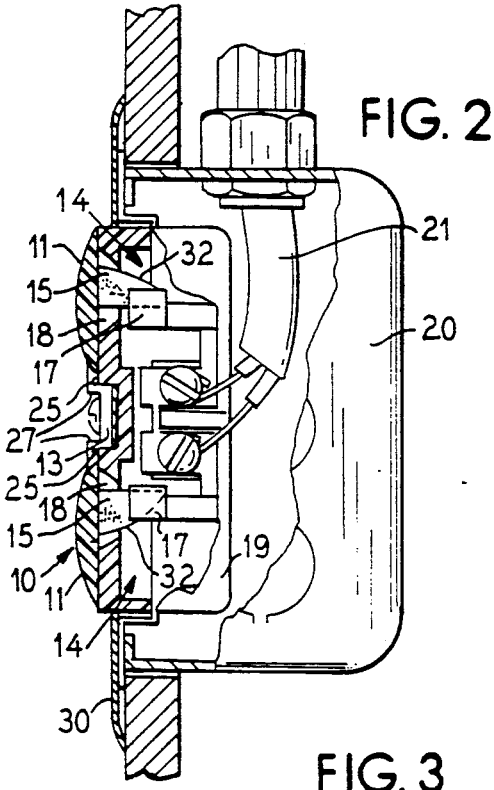
FIG. 2 is a sectional detail view taken substantially along the line II—II in FIG. 1.
Figure 3:
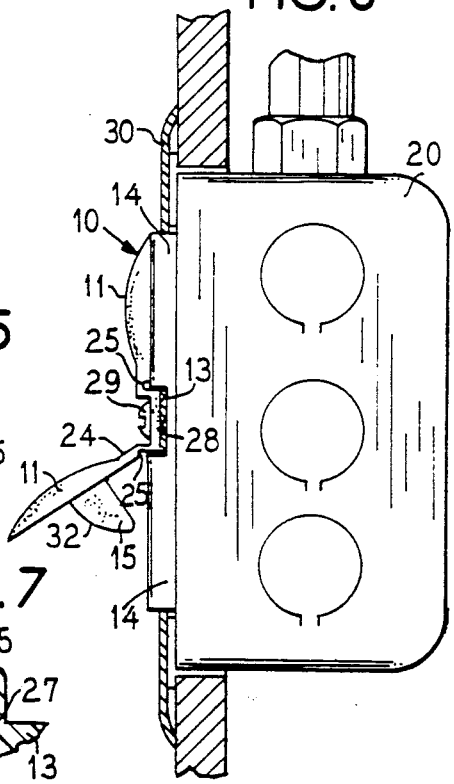
FIG. 3 is a side elevational view similar to FIG. 2 but showing one of the covers in an open position.
Figure 4:
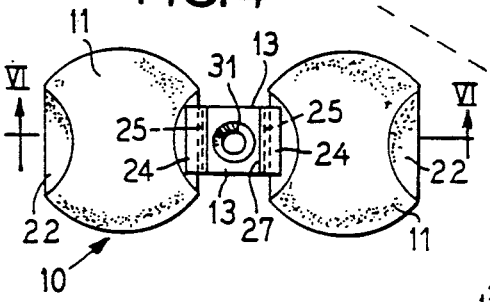
FIG. 4 is a plan view of the dual cover construction.
Figure 5:
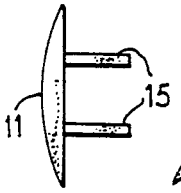
FIG. 5 is an end elevational view of the cover construction.
Figure 6:
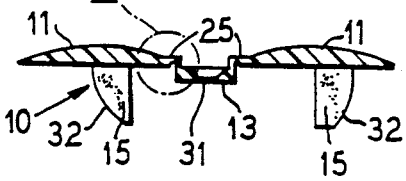
FIG. 6 is a sectional detail view of the cover construction taken substantially along the line VI—VI in FIG. 4.
Figure 7:
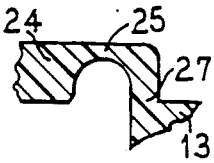
FIG. 7 is an enlarged fragmentary sectional detail view taken substantially within the balloon VII in FIG. 6.

Also, in order to accommodate the customary variable spacing of the prong receiving holes 18 in the sockets 14 in view of the provision for the customary grounding prongs of electrical plugs to be received by the sockets 14, the prongs 15 on the respective covers 11 are relatively offset in complementary fashion, as best seen in FIG. 2.

From the foregoing, it will be apparent that a new and improved, low cost, efficient dual electric socket safety cover construction has been provided which can be easily installed and operated by adult person manipulation. On the other hand, the construction is such that when the cover panels 11 are in closing relation to the associated electrical sockets, the electrical plug prong gripping spring fingers will grip the cover prongs 15 with sufficient force to substantially prevent infant or toddler access into the prong holes in the sockets.

It will be understood that variations and modifications may be effected without departing from the spirit and scope of the novel concepts of the present invention.

I claim as my invention:

1. A dual electrical socket safety cover construction, comprising:

a pair of cover members;

a hinge structure connecting said cover members;

means for attachment of said hinge structure between a pair of electrical sockets to be covered;

means on each of said cover members for pressure release retention with said sockets;

each of said cover members comprising a panel having a face for engagement with an associated electrical socket face;

each panel having a distal edge finger grip surface and a proximal edge hinge anchor bar;

a hinge portion attached to said anchor bar; and a connecting rib along said hinge portion attached to said attachment means.

2. A cover construction according to claim 1, comprising a one-piece unitary plastic structure.

3. A cover construction according to claim 1, wherein said means for pressure release retaining engagement on each of said cover members comprise a prong for gripped engagement by gripping structure of the associated electrical socket, and each of said prongs having a clearance relief edge facing generally toward a distal edge of the cover member to facilitate swinging of the prong into and out of position with respect to said gripping structure.

4. A cover construction according to claim 1, wherein said attachment means comprises an attachment base bar link equipped to be attached to an electrical socket assembly by means of an escutcheon plate securing screw.

5. A cover construction according to claim 4, wherein said link bar has antiturn surface structure cooperative in complementary relation with structure on the associated socket assembly.

6. In combination with a dual electrical socket assembly:

a safety cover construction comprising a pair of cover members;

a hinge structure connecting said cover members;

means for attachment of said hinge structure between a pair of electrical sockets to be covered in said assembly;

means on each of said cover members for pressure release retaining engagement with means associated with said sockets;

each of said cover members comprising a panel having a face for engagement with a face of the associated electrical socket;

each panel having a distal edge finger grip surface and a proximal edge hinge anchor bar;

a hinge portion attached to said anchor bar; and a connecting rib along said hinge portion attached to said attachment means.

7. A combination according to claim 6, wherein said cover construction comprises a one-piece unitary plastic structure.

8. A combination according to claim 6, wherein said means for pressure release retaining engagement on each of said cover members comprise a prong for gripped engagement by gripping structure of the associated electrical socket, and each of said prongs having a clearance relief edge facing generally toward a distal edge of the cover member to facilitate swinging of the prong into and out of position with respect to said gripping structure.

9. A combination according to claim 6, wherein said attachment means comprises an attachment base bar link attached to the electrical socket assembly by means of an escutcheon plate securing screw.

10. A combination according to claim 9, wherein said link bar has antiturn surface structure cooperative in complementary relation with structure on the associated socket assembly.

11. A dual electrical socket safety cover construction, comprising:

a pair of cover members;

a hinge structure connecting said cover members;

means for attachment of said hinge structure between a pair of electrical sockets to be covered;

means on each of said cover members for pressure release retention with said sockets; and anti-turn surface means on said hinge structure cooperative in complementary relation with surface means at the socket.

12. A safety cover construction according to claim 11, wherein said hinge structure includes a bar offset relative to said cover members and arranged to fit into a space between said electrical sockets.

13. A safety cover construction according to claim 11, wherein said cover members have distal edge finger grip surface means.

14. A dual electrical socket safety cover construction, comprising:

a pair of cover members;

a hinge structure connecting said cover members;

means for attachment of said hinge structure between a pair of electrical sockets to be covered;

means on each of said cover members for pressure release retention with said sockets;

each of said cover members having an arched structure opposite to the face of the cover member arranged to oppose the associated electrical socket; and finger grip surface means at distal edges of said cover members and comprising slabbed off oblique digitally engageable respective surfaces each terminating in a thin edge facilitating engagement therewith of an adult person's fingernail for releasing the cover member and hingedly swinging it away from its covering relation to the associated electrical socket.

15. A cover construction according to claim 14, wherein said hinge structure has anti-turn surface means cooperative with complementary surface means at the electrical sockets with which the cover construction may be assembled.

16. A cover construction according to claim 14, wherein said hinge structure includes a bar offset relative to said cover members and arranged to fit into a space between said electrical sockets.

* * * * *